United States Patent [19]

Klie et al.

[11] Patent Number: 4,699,095

[45] Date of Patent: Oct. 13, 1987

[54] GEARED COMPRESSED AIR STARTER

[75] Inventors: Jürgen Klie; Hans-Wilhelm Weiss, both of Sprockhovel, Fed. Rep. of Germany

[73] Assignee: G. Dusterloh GmbH, Sprockhovel, Fed. Rep. of Germany

[21] Appl. No.: 904,987

[22] Filed: Sep. 8, 1986

[30] Foreign Application Priority Data

Sep. 6, 1985 [DE] Fed. Rep. of Germany ..... 3531848

[51] Int. Cl.[4] ..... F02N 7/08

[52] U.S. Cl. ..... 123/179 F; 74/7 A; 74/7 E

[58] Field of Search ..... 123/179 F; 74/7 R, 7 A, 74/7 E; 60/625, 39.142

[56] References Cited

FOREIGN PATENT DOCUMENTS 0064009 11/1982 European Pat. Off. ..... 123/179 F 808303 7/1951 Fed. Rep. of Germany ..... 74/7 R 1190732 4/1965 Fed. Rep. of Germany ... 123/179 F

*Primary Examiner*—Andrew M. Dolinar

*Attorney, Agent, or Firm*—Toren, McGeady & Associates

[57] ABSTRACT

A geared compression air starter having a lead rotor, a driven rotor and a hollow shaft. A driven trunnion of the driven rotor engages with external teeth thereof into external teeth of the hollow shaft to connect the driven rotor with the hollow shaft. A freewheeling unit couples the hollow shaft with an axially displaceable engagement shaft so that the central axes of the engagement and of the hollow shaft can be positioned coaxially with respect to a central axis of the lead rotor. An engagement cylinder is connected with the engagement shaft by means of a piston rod which extends through the lead rotor, and the engagement cylinder is integrated into an end cover of the starter housing.

8 Claims, 3 Drawing Figures

GEARED COMPRESSED AIR STARTER

The present invention is directed generally to a gear-type compressed air starter having a lead rotor and a driven rotor.

In accordance with the prior art, particularly DE-PS No. 30 20 930, a driven trunnion of the driven rotor equipped with an external set of teeth meshes with inside gearing of a hollow shaft which is supported by two ball bearings arranged spaced from each other in a starter housing. A meshing or engagement shaft with a starter pinion on one end is provided in the hollow shaft so as to be rotatable as well as axially displaceable with respect thereto.

The engagement shaft is subject to the action of an engagement cylinder which is pneumatically actuated, and which is arranged in a longitudinal region of the hollow shaft and which engages with a piston rod into the engagement shaft to be rotatable but not axially displaceable with respect thereto.

Since the driven trunnion meshes with an inside gearing of the hollow shaft, three axes extend as it were through the starter housing, including that of the lead rotor, that of the driven rotor and that of the engagement shaft or the hollow shaft, so that there exist a total of three axes which have to be machined. Furthermore, the inside gearing of the hollow shaft causes difficulties concerning the mechanical machining, the heat treatment as well as the grinding of the parts of the apparatus. Thus, the load capacity of the engagement or meshing gear units remains within specific limits. The engagement gear unit consisting of the hollow shaft and the engagement shaft coupled with the hollow shaft by means of a freewheeling mechanism results in a fairly long unit, since an engagement cylinder has to be housed between the rotors and the engagement shaft. The return means of the engagement cylinder consisting of a helical compression spring can be laid out only up to a certain limited size, if the starter housing is not to be sized with unacceptable dimensions.

A peripheral valve system serves for controlling the rotational movement of the engagement shaft. Thus, gaps between the teeth can be reliably determined during engagement of the starting pinion in the ring gear of a prime mover and the runup of the starting rotors is only initiated when the starter pinion is completely engaged. The valve system is designed to be simple and operationally reliable. It consists of units which, as a rule, are attached directly at the starter housing, so that only channel connections are required to the rotor spaces and to the engagement cylinder.

It has, however, been found that these channel connections can only be fabricated with great difficulty and considerable fabrication costs, wherein some forms of compressed air starters even require external ducts. The reason for these problems lies in principle in that the channel connections to the engagement cylinder have to be conducted in the area of the engagement gear unit, wherein at least one channel is required for actuation of the engagement cylinder, one channel for the indication of the engaged position as well as an exhaust channel. Over and above that, the engagement cylinder including its return arrangement constituted by the helical compression spring requires a significant installation space within the engagement gear unit. Thereby, the design possibilities of the engagement gear unit as well as the engagement cylinder are impaired. Thus, it is, for instance, possible to utilize an engagement gear unit which exclusively exhibits external teeth with an effort which is completely unacceptable in practice. Furthermore, there arise difficulties with regard to the optimum dimension of the return element.

SUMMARY OF THE INVENTION

The present invention is directed toward improving gear-type compressed air starters of the prior art in such a way that channel conduits are no longer required in the gearing area of the engagement gear unit and that the engagement gear unit as well as the engagement cylinder can be sized simply and at the same time optimally within the starter housing.

In accordance with the invention, a geared compressed air starter is comprised of a housing, a lead rotor, a driven rotor and a hollow shaft supported in the housing. A driven trunnion having external teeth engaging with external teeth of the hollow shaft permanently connects the driven rotor with the hollow shaft. A freewheeling mechanism couples the hollow shaft and the engagement shaft together. An engagement cylinder arranged in a front face of the lead rotor facing away from said hollow shaft has a piston with a piston rod, with the piston being pneumatically actuated on one side thereof and spring actuated on the other side thereof. Bearing means support the piston rod in the hollow shaft, with the piston rod engaging into the engagement shaft so as to be rotatable and axially fixed with respect thereto.

In accordance with the invention, a central axis of the engagement shaft extends coaxially with respect to a central axis of the lead rotor.

A considerable advantage of the invention consists in that now only two axes of rotation and thus also two axes which must be machined exist in the starter housing. The elimination of the third axis to be machined diminishes the total construction effort so that the starter can be given smaller dimensions and thus can also be produced at a considerably lower cost.

Since the engagement cylinder has been provided on the front face of the lead rotor facing away from the hollow shaft, the engagement gear unit can be constructed to be shorter. Installation space for the engagement cylinder is no longer required. Such an arrangement of the engagement cylinder has the additional advantage that the channel connection from the peripheral valve system to the engagement cylinder is direct and therefore can be designed to be short. The channels carrying the compressed air thus are no longer located in the gearing area of the engagement gear unit. Thus, an intermediate place hitherto required is eliminated. Also, the support of the rotors is simpler. Overall, there results a simpler construction which is easier to produce as well as to assemble. Furthermore, it is considered advantageous that the hollow shaft is equipped with an external set of teeth. Such an external set of teeth can be mechanically produced much more simply, facilitating heat treatment and grinding procedures. Apart from simplified fabrication, there results the additional advantage of an increased load carrying capacity.

The piston rod of the engagement cylinder is carried through the lead rotor across its entire length, wherein only the coupling with the engagement shaft is designed in the area of the engagement gear unit, said coupling being rotatable, but not axially displaceable. In this way, servicing of the compressed air starter as well as possibly occurring repairs are simplified.

The support of the hollow shaft on the one hand as well as that of the engagement shaft on the other hand may be advantageously accomplished in that the needle bearings provided between the hollow shaft and the engagement shaft are indeed radially stressed during runup of the starter, however, they do not rotate. Only the liberally sized ball bearings between the hollow shaft and the starter housing on the one hand and the bearing trunnion of the leading rotor on the other hand rotate while under a radial load. If, after the starting process, the prime mover has been started, the freewheeling mechanism naturally assumes the override position and the needle bearing can rotate with very high rpms. Now, however, they are no longer subjected to radial stresses. Thus, the rpm of the ball bearing supporting the hollow shaft is limited to the rpm of the starter. Overall, there thus results an extraordinary positive assignment of the occurring radial stresses to the heavy duty ball bearings supporting the hollow shaft and of the high relative rpms to the high speed needle bearings. The disassembly and reassembly of the starter is simplified and the need for separate installation space may be eliminated.

In accordance with some more detailed features of the invention, the return means for the engagement cylinder can be laid out in an optimum manner. Thus, it is possible to relatively easily design the annular gap between the piston rod of the engagement cylinder and the lead rotor to be appropriately large, so that a sufficient installation space is available.

By attaching a timing valve optimally influencing the starting procedure upon the end face of the end cover, which end face is designed flat, the overall number of the flat faces to be machined is reduced.

The number is further reduced if the sealing dish of an exhaust valve is also supported upon this end face.

The various features of novelty which characterize the invention are pointed out with particularity in the claims annexed to and forming a part of this disclosure. For a better understanding of the invention, its operating advantages and specific objectives attained by its use, reference should be had to the drawings and descriptive matter in which there is illustrated and described a preferred embodiment of the invention.

DETAILED DESCRIPTION OF THE PREFERRED EMBODIMENT

Figure 1:
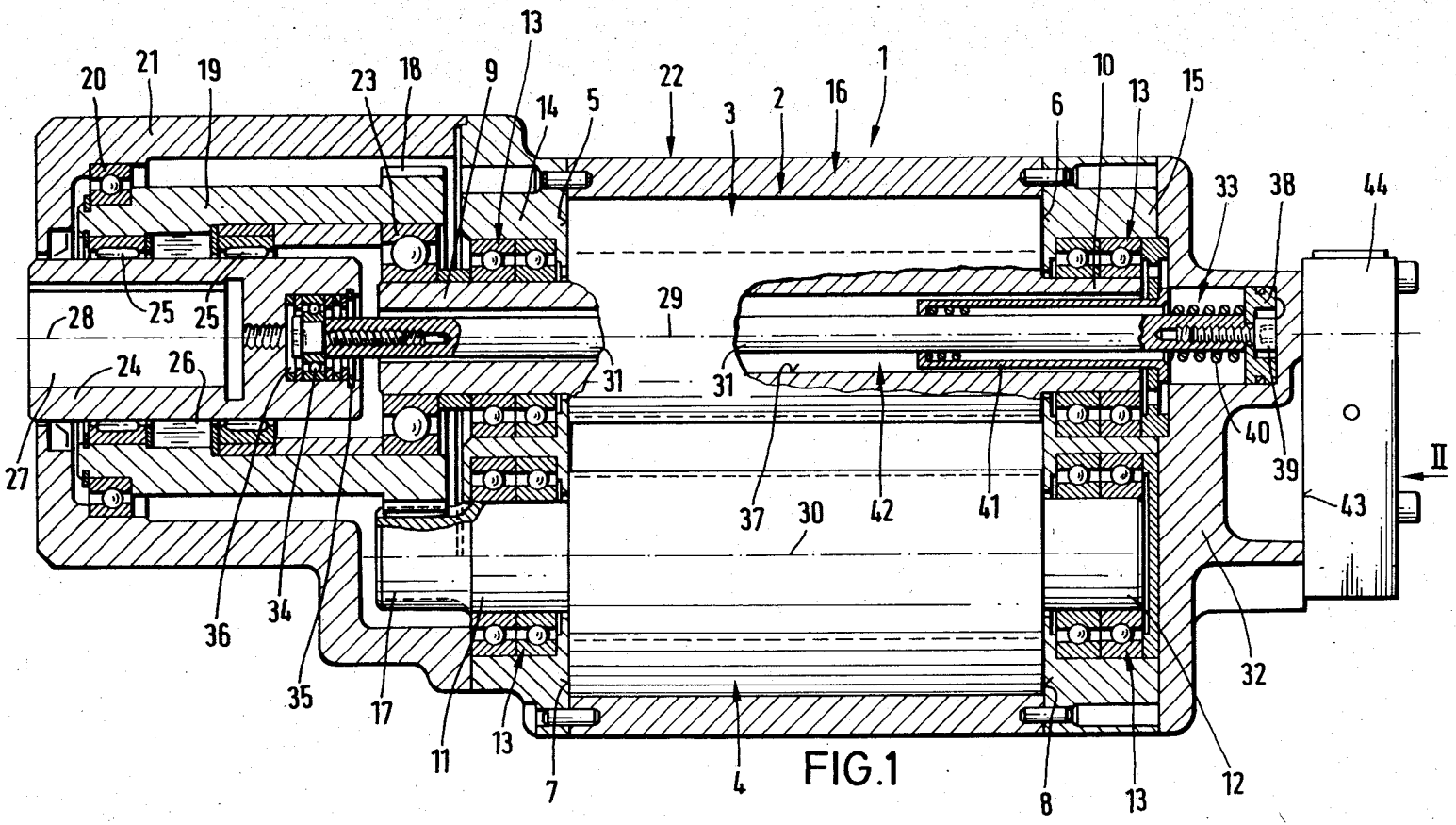
FIG. 1 is a vertical longitudinal section showing a gear-type compressed air starter.
Figure 2:
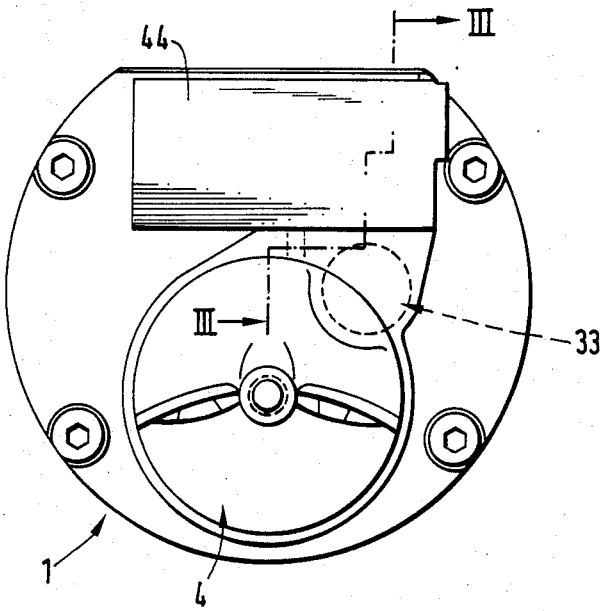
FIG. 2 is a front view of the compressed starter of FIG. 1 taken in the direction of arrow II with the exhaust valve and main valve removed.
Figure 3:
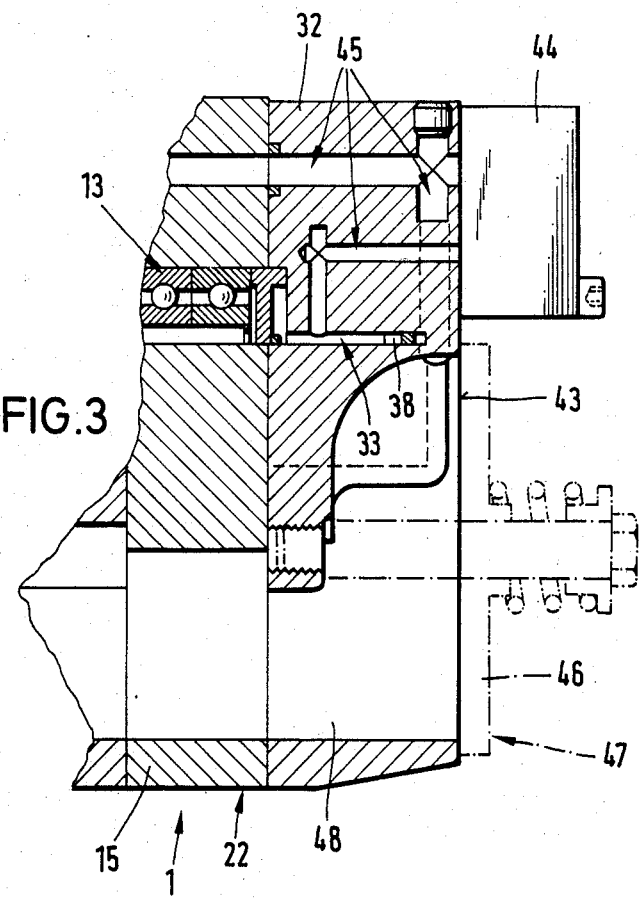
FIG. 3 is a magnified section through the compressed air starter in FIG. 2 along the line III—III.

Referring now to the drawings, a gear-type compressed air starter 1, in accordance with the invention, is depicted in FIGS. 1-3 in the condition in which it is used to start a prime mover, such as an internal combustion engine or a gas turbine.

The compressed air starter 1 comprises a rotary piston motor 2 with a lead rotor 3 and a driven rotor 4 (FIG. 1). Both rotors 3, 4 are supported in ball bearings 13 by trunnions 9-12 projecting from their front faces 5-8. The ball bearings are located in rotor end covers 14, 15 which border the rotor housing 16 on the end sides.

The driven trunnion 11 of the driven rotor 4 is provided with an external set of teeth 17 which mesh with an external set of teeth 18 of a hollow shaft 19; which is supported by means of a ball bearing 20 in a pot-like cover part 21 of the starter housing 22 and by means of an additional ball bearing 23 on the outer contour of the bearing trunnion 9 of the lead rotor 3.

A rotatable and axially displaceable engagement shaft 24 is provided inside of the hollow shaft 19 (FIG. 1), the engagement shaft being spaced from the hollow shaft 19 by means of needle bearings 25. A freewheeling mechanism 26 serves for coupling the hollow shaft 19 and the engagement shaft 24 together. The engagement shaft 24 comprises a recess 27 into which a replaceable starter pinion can be inserted.

As can be further discerned from FIG. 1, the common central axis 28 of the engagement shaft 24 and the hollow shaft 19 extends coaxially with the central axis 29 of the lead rotor 3. Thus, only two rotational axes and with this also two axes to be machined exist in the compressed air starter 1, there being the common rotational axis 29, 28 of the lead rotor 3, engagement shaft 24 and hollow shaft 19 on the one hand and the rotational axis 30 of the driven rotor 4 on the other hand.

The piston rod 31 of an engagement cylinder 33 integrated into the end cover 32 of the rotor housing 16 is rotatably supported axially fixed at the inner end of the engagement shaft 24. The support is by means of a ball bearing 34, which is fixed in a recess 36 of the engagement shaft 24 by means of a snap ring 35.

The piston rod 31 penetrates a stepped longitudinal bore 37 of the lead rotor 3 and is detachably connected with the piston 38 of the engagement cylinder 33 by a screw 39. The piston 38 is pneumatically actuated (See FIGS. 1 and 3) in the direction of the engagement shaft 24. On the other side, a helical compression spring 40 abuts at the piston 38, the spring 40 also abutting on a spring sleeve 41 which extends into an annular gap 42 between the piston rod 31 and the lead rotor 3. A timing valve 44 is attached at the flat end face 43 of the end cover 32. A channel conduit 45 between the timing valve 44 and the lead rotor 3 or the engagement cylinder 33 illustrated in detail in FIG. 3 provides a compressed air supply.

Furthermore, as is discernible from FIG. 3, a sealing dish 46 of an exhaust valve 47 abuts at this flat surface 43. The exhaust valve closes off an exhaust opening 48 in the starter housing 22.

By incorporating the timing valve 44 into the compresse air supply 45 to the starter motor 2 and to the engagement cylinder 33, axial movement of the engagement shaft 24, during the starting process, is generated by a force which acts with a variable magnitude upon the starting pinion up to the point of engagement of the starter pinion into the flywheel gearing. The force causing rotation is applied at least up to the partial engagement into the flywheel gearing in a hereto phase staggered periodically alternating magnitude. Thus, the starting pinion is subjected periodically to a short slow rotation with small or nonexisting advance force which is subsequently stopped again by removal of the rotational force, whereby the advance force is simultaneously increased. In this manner, the possibly jammed freewheeling mechanism 26 frees itself immediately, particularly if the cadence occurs in the opposite rotational direction so that the axial force does not have to overcome any additional resistances. Because the introduction of the force is partially interrupted, forcing during engagement cannot occur. Rather, the starting pinion slides softly into the flywheel gearing, because it seeks the path of least resistance. Thus, wear phenomena can no longer occur. Because of this condition, the useful life of the starter pinion and thus also the useful life of the flywheel gearing is considerably increased. This is, for instance, of particular significance in those cases where maintenance as well as repair of a starter and of a prime mover is difficult to accomplish. By this, it is intended to mean principally the accessibility of these aggregates, wherein, for instance, their location on ocean liners is meant.

Thus, in accordance with the invention, contrary to the conventional gear-type compressed air starter, the driven trunnion 11 of the driven rotor 4 now engages into an external set of teeth 18 of the hollow shaft 19 coupled through a freewheeling mechanism 26 with the engagement shaft 24. In this way, the central axes 28 of the engagement shaft 24 and the hollow shaft 19 can be positioned coaxially with respect to a central axis 29 of the lead rotor 3. The engagement cylinder 33 is connected with the engagement shaft 24 by means of a piston rod 31 penetrating through the lead rotor 3. The engagement cylinder 33 is integrated into an end cover 32 of the starter housing.

While a specific embodiment of the invention has been shown and described in detail to illustrate the application of the inventive principles, it will be understood that the invention may be embodied otherwise without departing from such principles.

What is claimed is:

1. A geared compressed air starter comprising: a housing; a lead rotor having a central axis; a driven rotor; a hollow shaft having external teeth supported in said housing; an axially displaceable engagement shaft having a central axis arranged so that its central axis extends coaxially with said central axis of said lead rotor; a driven trunnion having external teeth engaging with said external teeth of said hollow shaft permanently connecting said driven rotor with said hollow shaft; a freewheeling mechanism coupling said hollow shaft and said engagement shaft together; an engagement cylinder arranged in a front face of said lead rotor facing away from said hollow shaft, said engagement cylinder having a piston with a piston rod, said piston being pneumatically actuated on one side thereof and spring actuated on an opposite side thereof; and bearing means supporting said piston rod in said hollow shaft with said piston rod engaging into said engagement shaft so as to be rotatable and axially fixed with respect thereto.

2. A starter according to claim 1, wherein said hollow shaft is supported on one end thereof by means of a ball bearing inside said housing and at another end by means of a second ball bearing located on an outer contour of a bearing trunnion of said lead rotor.

3. A starter according to claim 1, wherein said hollow shaft is spaced from said engagement shaft by means of needle bearings.

4. A starter according to claim 1, wherein said hollow shaft and said engagement shaft are embedded into a pot-like cover part of said housing.

5. A starter according to claim 1, wherein said engagement cylinder is constructed in an end cover of said housing.

6. A starter according to claim 1, wherein said piston is spring actuated on said opposite side thereof by a helical compression spring embracing said piston rod, said spring abutting said piston on one side thereof and abutting on another side thereof at a spring sleeve which penetrates into an annular gap between said piston rod and said lead rotor.

7. A starter according to claim 5, wherein a timing valve is attached on a flat end face of said end cover.

8. A starter according to claim 7, wherein said sealing disk of an exhaust valve abuts upon said flat end face of said end cover.

* * * * *